US006935458B2

(12) United States Patent
Owens

(10) Patent No.: US 6,935,458 B2
(45) Date of Patent: Aug. 30, 2005

(54) MICROPHONE SHROUD AND RELATED METHOD OF USE

(76) Inventor: Thomas G. Owens, 46166 Antoine Ct. East, Macomb Twp., MI (US) 48044

( * ) Notice: Subject to any disclaimer, the term of this patent is extended or adjusted under 35 U.S.C. 154(b) by 48 days.

(21) Appl. No.: 09/962,876

(22) Filed: Sep. 25, 2001

(65) Prior Publication Data

US 2003/0057012 A1 Mar. 27, 2003

(51) Int. Cl.[7] ..... G10K 11/00
(52) U.S. Cl. ..... 181/205
(58) Field of Search ..... 181/205, 199; 381/360, 361, 359

(56) References Cited

U.S. PATENT DOCUMENTS

| | | | | |
|---|---|---|---|---|
| 2,520,706 | A | | 8/1950 | Anderson et al. |
| 2,623,957 | A | | 12/1952 | Cragg et al. |
| 3,154,171 | A | | 10/1964 | Knutson et al. |
| 3,478,799 | A | | 11/1969 | Hoyt, Jr. |
| 4,057,124 | A | | 11/1977 | Braden |
| 4,570,746 | A | | 2/1986 | Das et al. |
| 4,600,077 | A | | 7/1986 | Drever |
| 4,625,827 | A | | 12/1986 | Bartlett |
| 4,887,693 | A | | 12/1989 | Plice |
| 4,966,252 | A | | 10/1990 | Drever |
| 4,967,874 | A | | 11/1990 | Scalli |
| 4,979,586 | A | | 12/1990 | Lazzeroni et al. |
| 5,243,659 | A | | 9/1993 | Stafford et al. |
| 5,288,955 | A | | 2/1994 | Staple et al. |
| 5,329,593 | A | | 7/1994 | Lazzeroni et al. |
| 5,410,608 | A | * | 4/1995 | Lucey et al. ..... 381/360 |
| 5,684,880 | A | | 11/1997 | Lazzeroni et al. |
| 5,691,515 | A | | 11/1997 | Landis |
| 5,808,243 | A | | 9/1998 | McCormick et al. |

* cited by examiner

*Primary Examiner*—Kimberly Lockett
(74) *Attorney, Agent, or Firm*—VanOphem & VanOphem, P.C.

(57) ABSTRACT

A shroud and method capable of attenuating undesirable environmental noise from reaching a microphone. The shroud is a cover including a closed end, an open end substantially opposite of the closed end, and an intermediate portion that extends away from the closed end toward the open end. The intermediate portion includes a back side with a mouth opening that faces a user's mouth. The intermediate portion further includes a front side that is substantially opposite of the back side, with the front side being impermeable to airflow. Preferably, the shroud mounts over a windsock that mounts over the microphone. A flexible fastener may be secured to a portion of the open end so that the shroud more snugly mounts around the microphone. As such, the shroud shields a microphone from harsh environmental conditions such as wind and rain.

18 Claims, 1 Drawing Sheet

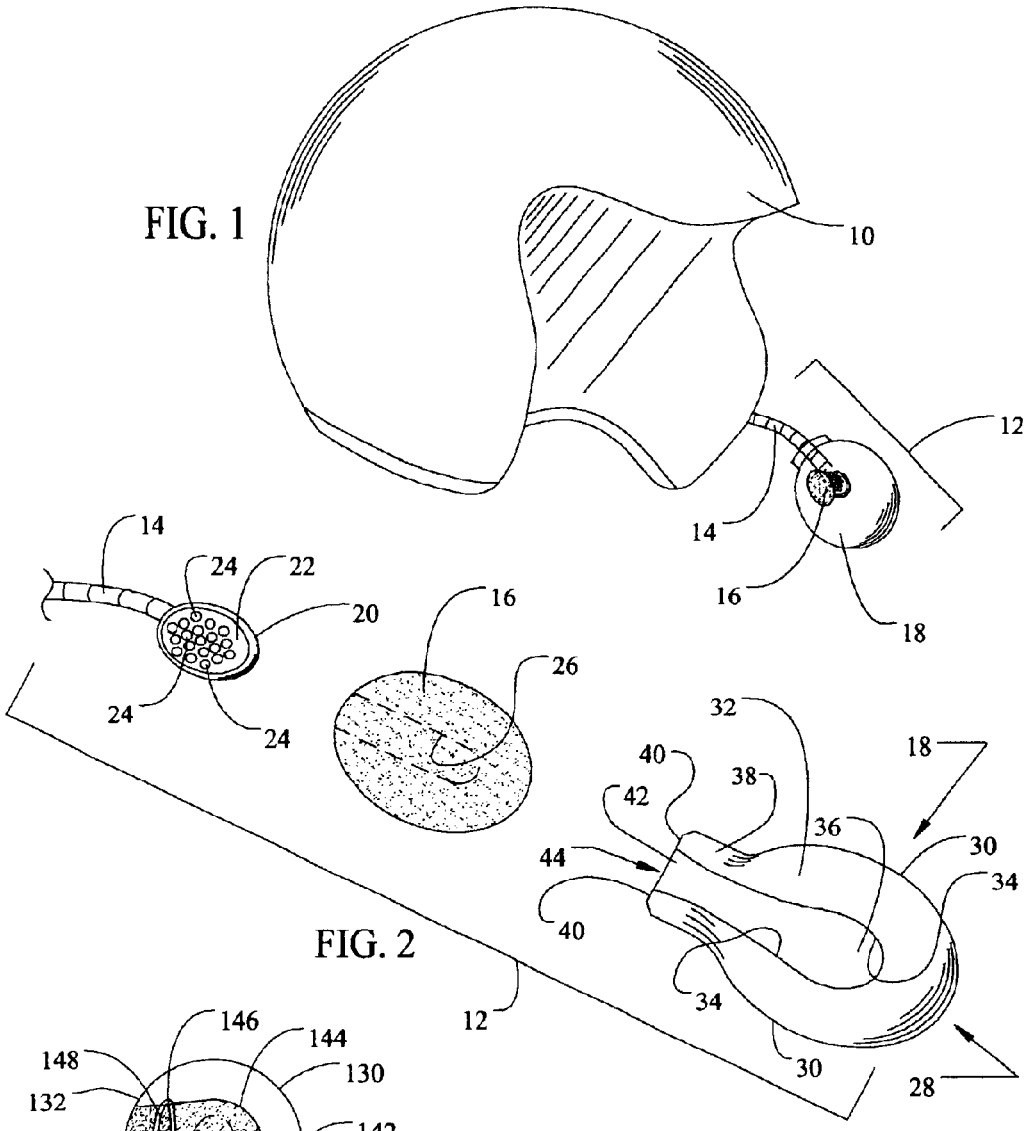
FIG. 1
FIG. 2
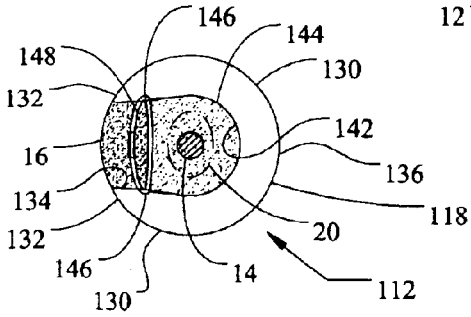
FIG. 3

MICROPHONE SHROUD AND RELATED METHOD OF USE

CROSS-REFERENCES TO RELATED APPLICATIONS

Not applicable.

FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention generally relates to microphone technology. More specifically, this invention is directed to a shroud, and related method, for mounting over a helmet-mounted microphone, such that undesirable environmental noise is attenuated, yet desired input signals are not so attenuated.

2. Description of the Related Art

Outdoor microphones are widely used in various applications by various people including television reporters, public addressers, movie makers, and motorcycle riders. These microphones are generally exposed to extremely harsh environmental conditions including wind noise, traffic noise, and vibrational noise. Such noise adversely affects performance of microphones in terms of sound quality transmission. Therefore, it is important to protect the integrity of the microphone output signal by better isolating desired voice input signals from undesired environmental noise.

The prior art has suggested various methods of mitigating the effects of environmental noise on microphone output quality. A classic example is use of a noise suppressing filter mounted over the microphone as taught by Knutson et al., U.S. Pat. No. 3,154,171. Knutson et al. disclose a conventional microphone having a porous urethane wind screen enclosing the microphone on all sides. The wind screen acts to diffuse wind turbulences before they reach the microphone. Such an article is more commonly known today as a windsock, is typically composed of open-cell foam, and is widely used on microphones of many different varieties. One disadvantage with this approach is that the foam tends to deteriorate under exposure to the outdoor environment. A more significant disadvantage is that foam windsocks tend to be effective only up to a certain minimal wind velocity. Therefore, the Knutson et al. solution is not effective under high air turbulence where there are relatively high winds or where the microphone is moving at a high rate of speed.

Another approach, U.S. Pat. No. 4,570,746 to Das et al. and assigned to International Business Machines, teaches use of a wind/breath screen enclosing a microphone and part of a microphone cable extending from the microphone. Das et al. disclose the wind/breath screen including a rigid perforated structure having two semi-spheres hinged together to form a full perforated sphere for mounting over the microphone. The sphere is supported by and snaps shut around a grommet that encircles the microphone cable. Additionally, a latex foam layer is mounted to and surrounds the sphere. Thus, Das et al. teach that a pad of dead air results between the sphere and the microphone. Unfortunately, however, Das et al. does not fully solve the problems with the Knutson et al. reference. The foam layer is still not effective under high air turbulence regardless of the dead layer of air and the heavily perforated sphere. Air turbulence impulses can still penetrate the foam, the perforated sphere, and the dead air, and can still impinge on the microphone.

Still another approach is disclosed in U.S. Pat. No. 5,288,955 to Staple et al. assigned to Motorola, Inc., which teaches a microphone mounting arrangement for reducing noise arising from wind and vibration. Staple et al. disclose the microphone mounting arrangement including a bullet-shaped tubular housing having a rounded front portion and a flat rear portion. The tubular housing is shown mounted to the handlebars of a bicycle. A microphone is mounted within the tubular housing in the flat rear portion thereof and is secured therein by a round rubber boot. A disadvantage, however, is that the Staple et al. microphone lacks the benefits of a foam windsock. Another disadvantage is that the Staple et al. microphone is specially and newly designed and is not adaptable to already existing and readily available microphones. Thus, the Staple et al. microphone is a cost prohibitive solution to the above-mentioned problems in the prior art.

Other approaches include various electronic signal processing techniques to either filter out unwanted noise and/or to cancel out such noise. Unfortunately, such high-tech, high-cost approaches involving noise filtering and canceling do not sufficiently attenuate environmental noises, especially wind noise. In fact, these electronic approaches usually reduce environmental noise but do so at the expense of attenuating desired sound signals, and degrading sound clarity and overall quality.

Motorcycle enthusiasts are particularly interested in microphone technology involving environmental noise attenuation. U.S. Pat. No. 4,979,586 to Lazzeroni et al. exemplifies a typical helmet headset that is very popular among motorcycle riders, and that is associated with the J&M Corporation of Tucson, Ariz. Such headsets include a foam-covered microphone that is positioned directly in front of a motorcyclist's mouth and that is supported by a flexible boom that attaches to one side of a helmet. Such headsets are used as communication systems in speech between a motorcycle driver and passenger, as well as between motorcycle drivers on different motorcycles. The headsets are also used to plug into and transmit signals from on-board AM/FM radio equipment.

Motorcycle helmet headsets are particularly susceptible to environmental noises including that from headwind, crosswind, nearby traffic, tunnel echoes, and motorcycle engine noise. Motorcyclists prefer that a headset microphone transmit only desired speech in a clear manner. Unfortunately, however, environmental noise is a significant problem for a couple of reasons. First, the environmental noise degrades microphone transmission quality as discussed previously. Additionally, the environmental noise tends to inadvertently interrupt radio signals being transmitted from the on-board AM/FM radio to the speakers of the headset. Motorcycle riders tend to find this annoying and inconvenient. Voice activated technology (VOX) may be responsible for this problem. VOX often misinterprets environmental noise as desired speech and cuts out the radio signal, subordinating it to the headset communication system.

Accordingly, U.S. Pat. No. 5,243,659 to Lazzeroni et al. teaches an improved VOX system that automatically compensates for increased environmental noise so that a motorcycle rider does not have to adjust the sensitivity settings of the VOX to avoid the above-described interruption problem. Unfortunately, such a solution amounts to yet another of the many electronic signal processing techniques, which are not fully adequate to solve the environmental noise problems of the prior art, as discussed above.

From the above, it can be appreciated that microphone devices of the prior art are not fully optimized to adequately suppress unwanted environmental noise. Therefore, what is needed is a simple and cost-effective solution that is readily adaptable for use with existing microphones and that significantly isolates desired microphone input signals from undesired environmental noise to improve microphone performance.

BRIEF SUMMARY OF THE INVENTION

According to the preferred embodiment of the present invention, there is provided a contoured enclosure or shroud for mounting over a microphone. The shroud includes a closed end, an open end that is substantially opposite the closed end, and an intermediate portion therebetween. Between the open and closed ends, the intermediate portion of the shroud defines a mouth opening for facing a user's mouth. Substantially opposite the mouth opening of the shroud is disposed a portion of the shroud that is impermeable to airflow so that wind does not directly impinge on the microphone. Preferably, the shroud mounts over a windsock that is mounted over the microphone. The shroud can also include a resilient fastener that is secured to a portion of the front end of the shroud so that the shroud more snugly mounts around the microphone. As such, the shroud shields the microphone from harsh environmental conditions such as wind and rain.

In another aspect of the present invention, there is provided a method of shielding a microphone from undesirable sound input. The method includes providing a microphone, then mounting a shroud over microphone such that a mouth opening of the shroud is oriented toward a user's mouth, wherein the shroud has an impermeable portion opposite of the mouth opening. Preferably, a separate windsock is mounted over the microphone before the shroud is mounted over the microphone, such that the windsock is interposed the microphone and shroud.

It is an object of the present invention to provide a shroud and method for shielding a microphone against harsh environmental conditions such as wind and rain.

It is another object that the shroud and method do not attenuate, but rather improve the clarity of a voice signal through a microphone.

It is still another object that the shroud is configured to mount easily to preexisting and readily available microphones and/or windsocks.

It is yet another object that the shroud is relatively inexpensive and simple to produce.

It is a further object that the shroud is partially open on one side and impermeable on another side.

It is yet a further object to use the shroud to attenuate wind noise entering a motorcycle headset microphone to prevent unintended interruption of radio signals being transmitted from an on-board AM/FM radio to the speakers of the headset.

These objects and other features, aspects, and advantages of this invention will be more apparent after a reading of the following detailed description, appended claims, and accompanying drawings.

BRIEF DESCRIPTION OF THE SEVERAL VIEWS OF THE DRAWINGS

FIG. 1 is a perspective view of a helmet and a microphone assembly according to the present invention;

FIG. 2 is an exploded view of a microphone assembly according to the preferred embodiment of the present invention; and FIG. 3 is an end view of a microphone assembly according to an alternative embodiment of the present invention.

DETAILED DESCRIPTION OF THE PREFERRED EMBODIMENT

Generally, a microphone shroud in accordance with the present invention is shown in the Figures in conjunction with a typical helmet mounted headset including a microphone. The term shroud is basically synonymous with the terms enclosure, deflector, cover, boot, body, baffle, etc.

Referring now in detail to the Figures, there is shown in FIG. 1 a ¾ open-faced helmet 10 having a microphone assembly 12 attached thereto. The microphone assembly 12 is part of a complete headset (not entirely shown) that includes earphones positioned inside the helmet 10. A complete headset is typified by the AeroMike® III helmet headset available from the J&M Corporation for between $120 and $220. The microphone assembly 12 generally includes a flexible boom 14, a microphone (not shown) attached to and terminating the flexible boom, a windsock 16, and a shroud 18.

As specifically shown in FIG. 2, the microphone assembly 12 also includes a microphone 20 that has a back surface 22 with openings 24 therethrough. A front surface (not shown) is disposed generally opposite the back surface 22 and is solid with no openings therethrough. As also shown in FIG. 2, the windsock 16 is composed of an open-cell material as is well known in the art. The windsock 16 includes a passage 26 extending partially therethrough for mounting over the microphone 20, as is also well known. Windsocks are inexpensive and are readily available in the marketplace for about $5 to $7 each, for example from the J&M Corporation. Windsocks are also known as windscreens and are made of sponge-like foam to thwart undesirable noise from wind and rapid microphone movement. Unfortunately, however, the windsock 16 is not capable of blocking wind from impinging on the microphone 20 since the windsock 16 is permeable. Thus, wind and other unwanted environmental noise impinges directly on the microphone 20 thereby distorting microphone output quality.

Therefore, it is preferable that the shroud 18 mounts over the windsock 16, which is in turn mounted over the microphone 20. Alternatively, however, it is well within the ordinary skill in the art and is contemplated that the shroud 18 could be adapted to mount directly over the microphone 20 without any windsock, or even with the windsock 16 mounted over the shroud 18.

The shroud 18 includes a closed end 28, an intermediate portion 30 having a back side 32 with a mouth opening 34 therethrough, and further having a front side 36 substantially opposite the back side 32, wherein the front side 36 is impermeable to block wind and other environmental elements. The shroud 18 is mounted over the windsock 16 and microphone 20 such that the mouth opening 34 faces toward the inside of the helmet (not shown) so as to be oriented with a user's mouth. Because of the orientation of the mouth opening 34, only voice pulses from a user's mouth directly impinge on the microphone 20 through the windsock 16, and wind pulses are blocked by the solid impermeable intermediate portion 30 of the shroud 18.

The intermediate portion 30 of the shroud 18 extends longitudinally from the closed end 28, tapers to a reduced diameter to define a neck portion 38, and terminates in longitudinal edges 40 that define a mounting opening 42 at an open end 44 of the shroud 18. The closed end 28 and the open end 44 together establish a longitudinal axis of the shroud 18. The mounting opening 42 is disposed in a plane generally transverse to the longitudinal axis of the shroud 18, while the mouth opening 34 is disposed in a plane generally parallel with the longitudinal axis of the shroud 18. As shown, it is preferred that the mounting opening 42 overlap or be in open edgewise communication with the mouth opening 34 such that both openings 42 and 34 define one large slot-like opening. Alternatively, however, the mouth opening 34 could be an isolated aperture such as a complete aperture. The shroud 18 is composed of a thermoplastic rubber, and is preferably injection molded from Santoprene® grade 111-87. It is contemplated, however, that the shroud 18 could be made of any material that flexes enough to snugly mount over the microphone 20. Therefore, the shroud 18 is flexible, but resilient, such that the mounting opening 42 expands and easily fits over the windsock 16 that is preferably mounted directly over the microphone 20.

The entire shroud 18 is preferably impermeable to block wind and other environmental noise from impinging on the microphone 20. It is also preferable that the shroud 18 be a generally hollow body having a relatively thin walled cross section that is substantially impermeable to airflow. Alternatively, however, it is contemplated that the shroud 18 could be composed of a generally open cell foam material like a windsock. Unlike a windsock, however, the shroud 18 has an impermeable front side for deflecting wind. Such an impermeable front side may be integrally produced by selective singeing or burning, or any other technique suitable for closing a portion of the open cell foam. For example, selective singeing would solidify and close portions of the open cell foam to make those portions impermeable. Thus, the mouth opening 34 would essentially be a portion of the open cell foam that is left unsinged. Hence, such a shroud would essentially integrate a traditional windsock 16 with the shroud 18 of the present invention to form one part.

A microphone assembly 112 in accordance with an alternative embodiment of the present invention is shown in FIG. 3. FIG. 3 depicts an end view of the microphone assembly 112 from an open end 144 toward a closed end (not shown) of a shroud 118. As discussed previously, the shroud 118 includes an impermeable front side 136 and an oppositely disposed back side 132.

The shroud 118 mounts over top of the windsock 16, the microphone 20, and a portion of the flexible boom 14. The shroud 118 includes an intermediate portion 130, a mounting opening 142 at the open end 144, and securing holes 146 through a portion of the open end 144. A resilient fastener 148 loops through the securing holes 146 as shown to urge the mounting opening 142 and mouth opening 134 toward a closed position and to thereby snugly mount the shroud 118 to the microphone 20 so that the shroud 118 does not fall off under extremely high wind speeds.

As an example, the resilient fastener 148 shown is a widely available hair accessory known as a ponytail holder that is typically used for holding long hair in a ponytail. It is contemplated, however, that any resilient fastening arrangement could be used to retain the shroud 118 on the microphone 20 including a resilient O-ring mounted around the neck portion 38 of FIG. 2.

The method of using the present invention is essentially a method of shielding the microphone 20 from undesirable sound input. The method includes providing the microphone 20, then preferably mounting the windsock 16 over the microphone 20. Uniquely, the method includes mounting the shroud 18 over the windsock 16 and microphone 20 such that a mouth opening or mouth opening 34 of the shroud 18 is oriented toward a user's mouth, wherein the shroud 18 is impermeable opposite of the mouth opening 34.

In accordance with the teachings of the present invention, several prototypes were fabricated for testing. Users of the device agree that the shroud reduces wind noise up to 80%, measured subjectively. Thus, desired voice signals are transmitted through the microphone more clearly than by using only the windsock without the shroud. More objectively, however, the users verify that using the shroud prevents wind noise from cutting out AM/FM radio operation, as discussed above. Accordingly, the present invention provides a relatively inexpensive and effective solution to a significant problem with comparatively expensive headset systems.

While the present invention has been described in terms of a preferred embodiment, it is apparent that other forms could be adopted by one skilled in the art. In other words, the teachings of the present invention encompass any reasonable substitutions or equivalents of claim limitations. For example, the structure, materials, sizes, and shapes of the individual components could be modified, or substituted with other similar structure, materials, sizes, and shapes. Specific examples include using a sphere-like shroud, a box-like shroud, a cup-like shroud, etc. Those skilled in the art will appreciate that other applications, including those outside of a helmet headset, are possible with this invention. Accordingly, the present invention is not limited to only helmet headsets. Further, the term impermeable means not capable of penetration through a surface by a fluid, such as airflow. Accordingly, the scope of the present invention is to be limited only by the following claims.

What is claimed is:

1. A shroud for mounting over a microphone, said shroud comprising:

a closed end;

an open end substantially opposite said closed end; and an intermediate portion extending from said closed end in a direction toward said open end, said intermediate portion defining a mouth opening therethrough, said shroud being entirely composed of an impermeable material.

2. The shroud as claimed in claim 1, wherein said shroud mounts over a windsock disposed intermediate said microphone and said shroud.

3. The shroud as claimed in claim 1, wherein said mouth opening is an aperture.

4. The shroud as claimed in claim 1, wherein said impermeable material is composed of a resiliently flexible material.

5. The shroud as claimed in claim 4, wherein said resiliently flexible material is a thermoplastic rubber.

6. A shroud for mounting over a microphone, said shroud comprising:

an impermeable hollow body comprising:

a closed end;

an open end substantially opposite said closed end, said open end having a mounting opening; and an intermediate portion extending from said closed end in a direction toward said open end, at least a portion of said intermediate portion having an edge defining said mounting opening of said open end, said intermediate portion defining a mouth opening therethrough, said intermediate portion being impermeable for at least a portion thereof substantially opposite said mouth opening.

7. The shroud as claimed in claim 6, wherein said mounting opening and said mouth opening overlap so as to form a continuous open-sided aperture from said intermediate portion around to said open end.

8. The shroud as claimed in claim 6, further comprising means for resiliently securing said shroud to said microphone.

9. The shroud as claimed in claim 6, wherein said impermeable hollow body is entirely composed of an impermeable material.

10. The shroud as claimed in claim 9, wherein said impermeable hollow body is composed of thermoplastic rubber.

11. A microphone shroud for mounting over a microphone to shield said microphone from undesirable sound input, said microphone shroud comprising:

an impermeable hollow body composed of a flexible material that defines a wall thickness of said impermeable hollow body, said impermeable hollow body comprising:

a closed end;

an open end substantially opposite said closed end, said open end having a mounting opening, said closed end and said open end establishing a longitudinal axis of said impermeable hollow body; and an intermediate portion extending from said closed end in a direction toward said open end, said intermediate portion at least partially terminating in a longitudinal edge, said longitudinal edge defining said mounting opening of said open end, said intermediate portion having a mouth opening therethrough, said intermediate portion being closed opposite said mouth opening so as to isolate said microphone from air turbulence so as to reduce undesirable noise entering said microphone;

whereby said open end of said microphone shroud is mountable over the end of said microphone, and further whereby said mouth opening enables voice input access to said microphone.

12. The microphone shroud as claimed in claim 11, wherein said flexible material is a thermoplastic rubber.

13.The microphone shroud as claimed in claim 11, wherein said mounting opening and said mouth opening overlap to define one continuous opening.

14. The microphone as claimed in claim 13, wherein said shroud includes securing holes proximate said open end and disposed on opposite sides of said on continuous opening.

15. The microphone as claimed in claim 14, further comprising means for resiliently securing said microphone shroud to said microphone.

16. The microphone shroud as claimed in claim 15, wherein said means for resiliently securing comprises a resilient band looped through said securing holes.

17. A method of shielding a microphone from undesirable sound input, said method comprising the steps of:

providing a microphone; and mounting a shroud over said microphone such that a mouth opening of said shroud is positionable toward a user's mouth, wherein said shroud is impermeable throughout at least a portion thereof that is generally opposite said mouth opening.

18. The method as claimed in claim 17, further comprising the step of mounting a windsock over said microphone before said step of mounting said shroud over said microphone.

* * * * *

UNITED STATES PATENT AND TRADEMARK OFFICE

CERTIFICATE OF CORRECTION

PATENT NO. : 6,935,458 B2
DATED : August 30, 2005
INVENTOR(S) : Thomas G. Owens

It is certified that error appears in the above-identified patent and that said Letters Patent is hereby corrected as shown below:

Column 8,
Line 17, after "said" delete "on" and insert -- one --.

Signed and Sealed this

Seventeenth Day of January, 2006

JON W. DUDAS
*Director of the United States Patent and Trademark Office*